US010141141B2

(12) United States Patent
Bergum

(10) Patent No.: US 10,141,141 B2
(45) Date of Patent: Nov. 27, 2018

(54) MAGNETICALLY ACTUATED SWITCH

(71) Applicant: S.J. Electro Systems, Inc., Detroit Lakes, MN (US)

(72) Inventor: Alan J. Bergum, Detroit Lakes, MN (US)

(73) Assignee: S. J. Electro Systems, Inc., Detroit Lakes, MN (US)

( * ) Notice: Subject to any disclaimer, the term of this patent is extended or adjusted under 35 U.S.C. 154(b) by 0 days.

(21) Appl. No.: 15/429,904

(22) Filed: Feb. 10, 2017

(65) Prior Publication Data

US 2017/0250041 A1 Aug. 31, 2017

Related U.S. Application Data

(60) Provisional application No. 62/300,480, filed on Feb. 26, 2016, provisional application No. 62/350,425, filed on Jun. 15, 2016.

(51) Int. Cl.

| | |
|---|---|
| ***H01H 9/00*** | (2006.01) |
| ***H01H 36/00*** | (2006.01) |
| ***H01H 35/18*** | (2006.01) |
| ***H01H 36/02*** | (2006.01) |

(52) U.S. Cl.
CPC ..... *H01H 36/0073* (2013.01); *H01H 35/18* (2013.01); *H01H 36/02* (2013.01)

(58) Field of Classification Search
CPC .... H01H 36/00; H01H 36/02; H01H 36/0073; H01H 35/18
USPC ..... 335/207
See application file for complete search history.

(56) References Cited

U.S. PATENT DOCUMENTS 2,777,914 A * 1/1957 Brown ..... G01F 23/60 200/84 C
3,013,135 A * 12/1961 Russo ..... G01F 23/70 200/84 C
3,022,397 A * 2/1962 Goellner ..... G01F 23/32 200/84 C
3,541,283 A * 11/1970 Milo ..... G01F 23/74 200/84 C
3,588,404 A * 6/1971 Akeley ..... G01F 23/64 200/84 C (Continued)

FOREIGN PATENT DOCUMENTS

WO 2000/57380 9/2000

OTHER PUBLICATIONS

International Search Report for Application No. PCT/US2017/017628 dated May 16, 2017 (5 pgs.).

*Primary Examiner* — Shawki S Ismail
*Assistant Examiner* — Lisa Homza
(74) *Attorney, Agent, or Firm* — Dicke, Billig & Czaja, PLLC

(57) ABSTRACT

A magnetically activated switch comprises an arm member, an actuating member, and a switch. The arm member has a first magnet and the actuating member has a second magnet. The actuating member is configured and arranged to move relative to the arm member thereby moving the second magnet relative to the first magnet. The second magnet has a repulsion force to the first magnet. The switch has a contact. Movement of the second magnet in a first direction past the first magnet positions the contact in an open position and movement of the second magnet in a second direction past the first magnet positions the contact in a closed position.

16 Claims, 13 Drawing Sheets

(56) References Cited

U.S. PATENT DOCUMENTS 3,602,665 A * 8/1971 Jarvis ..... G01F 23/56 200/83 B
3,632,925 A * 1/1972 Fujiwara ..... F04B 49/04 200/84 C
3,659,064 A * 4/1972 Inoue ..... G01F 23/32 200/84 C
3,751,616 A * 8/1973 Innes ..... G01F 23/38 200/84 C
3,980,979 A * 9/1976 Prosser ..... G01F 23/38 335/188
4,066,858 A * 1/1978 Piper ..... F22D 5/24 200/84 C
4,142,079 A * 2/1979 Bachman ..... H01H 36/02 200/84 C
4,186,419 A * 1/1980 Sims ..... G01F 23/72 200/84 C
4,481,389 A * 11/1984 Johnson ..... F16K 31/086 200/61.86
4,605,038 A * 8/1986 Tchitdjian ..... F16K 21/185 137/399
4,647,740 A * 3/1987 Hansen, III ..... H01H 36/02 200/84 C
4,742,195 A 5/1988 Bryant et al.
4,788,534 A * 11/1988 Engelhardt ..... G01P 1/10 200/81.9 M
4,836,239 A 6/1989 Kinkead
4,943,210 A 7/1990 Bailey, Jr. et al.
5,030,803 A * 7/1991 Yarbrough ..... H01H 36/02 200/84 C
5,042,300 A * 8/1991 Benjey ..... F01M 11/12 200/84 C
5,141,404 A 8/1992 Newcomer et al.
5,155,311 A 10/1992 Luke
5,262,604 A * 11/1993 Powell ..... H01H 36/02 200/84 C
5,283,402 A * 2/1994 Green ..... H01H 35/147 200/61.45 M
5,294,917 A 3/1994 Wilkins
5,324,171 A 6/1994 Cook
5,465,815 A 11/1995 Ikegami
5,562,422 A 10/1996 Ganzon et al.
5,621,393 A * 4/1997 Urich ..... G01F 23/70 335/207
5,629,659 A * 5/1997 Steiner ..... H01H 36/02 335/205
6,069,331 A * 5/2000 Utke ..... H01H 35/40 200/84 C
6,140,925 A * 10/2000 Lee ..... G01F 23/74 340/618
6,246,307 B1 * 6/2001 Friedman ..... H01H 36/0073 335/151
6,528,748 B2 * 3/2003 Harris ..... H01H 35/405 200/81.9 M
7,015,782 B2 3/2006 Kincaid et al.
8,215,335 B2 7/2012 Barnham
9,046,190 B1 * 6/2015 Chapman ..... F16K 31/24
2005/0068133 A1 * 3/2005 Romanik ..... H01H 36/0033 335/207
2010/0129232 A1 5/2010 Keener
2012/0125756 A1 * 5/2012 Wang ..... H01H 36/0006 200/84 C
2015/0332882 A1 * 11/2015 Bergum ..... H01H 35/186 200/84 R

* cited by examiner

MAGNETICALLY ACTUATED SWITCH

This application claims the benefit of U.S. Provisional Patent Application Ser. No. 62/300,480, filed Feb. 26, 2016, and U.S. Provisional Patent Application Ser. No. 62/350,425, filed Jun. 15, 2016.

BACKGROUND OF THE INVENTION

There are many types of electrical switches for pumps. With many of these pumps, there is a need for a compact switching module that can reliably and repeatedly turn on and turn off the pump. Some compact switch modules use a sealed arm to actuate a switching mechanism, some use magnets in attraction to a metal plate or that interact with other magnets to actuate a switch, and some use magnets and reed switches to actuate relays. Many of these systems are complex and require the use of springs and other mechanisms that toggle and hold the switches' contacts in closed or open positions. Many of these systems also cause unbiased forces on the actuating members causing wear on sliding members.

For the reasons stated above and for other reasons stated below, which will become apparent to those skilled in the art upon reading and understanding the present specification, there is a need in the art for simpler, more reliable switches.

BRIEF SUMMARY OF THE INVENTION

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, a magnetically activated switch comprises an arm member, an actuating member, and a switch. The arm member has a first magnet and the actuating member has a second magnet. The actuating member is configured and arranged to move relative to the arm member thereby moving the second magnet relative to the first magnet. The second magnet has a repulsion force to the first magnet. The switch has a contact. Movement of the second magnet in a first direction past the first magnet positions the contact in an open position, and movement of the second magnet in a second direction past the first magnet positions the contact in a closed position.

In one embodiment, a magnetically activated switch comprises an arm member, an actuating member, and a switch. The arm member has a first arm portion to which a first magnet portion is connected and a second arm portion to which a second magnet portion is connected. The first arm portion and the second arm portion form a channel therebetween. The actuating member has a second magnet and is configured and arranged to move relative to the arm member within the channel thereby moving the second magnet relative to the first magnet portion and the second magnet portion. The second magnet has repulsion forces to the first magnet portion and the second magnet portion. The switch has a contact. Movement of the second magnet in a first direction past the first magnet portion and the second magnet portion positions the contact in an open position, and movement of the second magnet in a second direction past the first magnet portion and the second magnet portion positions the contact in a closed position.

BRIEF DESCRIPTION OF THE DRAWINGS

The present invention can be more easily understood, and further advantages and uses thereof can be more readily apparent, when considered in view of the detailed description and the following Figures in which.

In accordance with common practice, the various described features are not drawn to scale but are drawn to emphasize specific features relevant to the present invention. Reference characters denote like elements throughout the Figures and the text.

DETAILED DESCRIPTION OF THE INVENTION

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Embodiments of the present invention provide a magnetically actuated switch.

The directional terms such as up, upward, down, and downward are being used with reference to the orientations shown in the Figures illustrating examples of embodiments and it is recognized that movement could be in any suitable direction not limited to those described.

Figure 2:
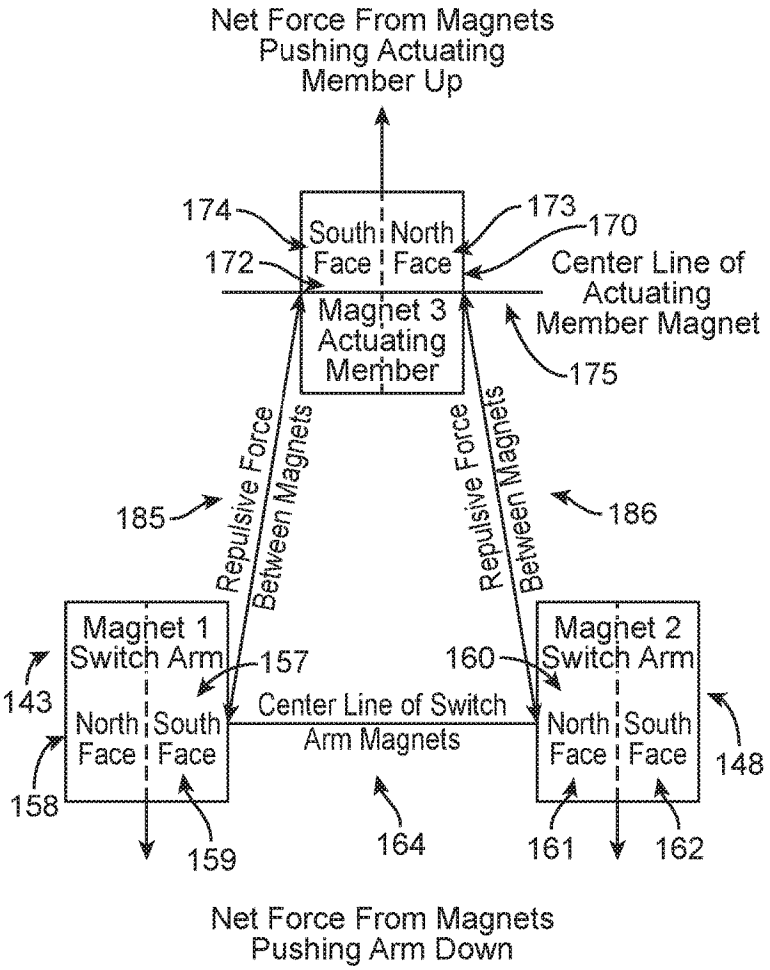
FIG. 2 is another schematic view of the actuating member and the switch arm shown in FIG. 1 illustrating operation of another switch activation in accordance with the principles of the present invention.
Figure 1:
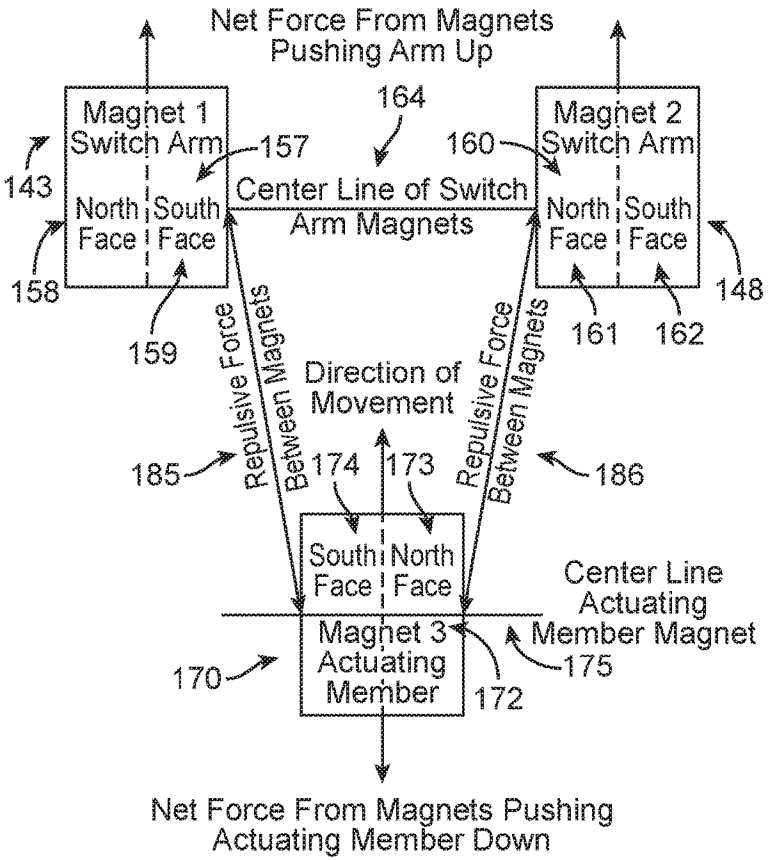
FIG. 1 is a schematic view of an actuating member and a switch arm illustrating operation of switch activation in accordance with the principles of the present invention.

In one embodiment, a magnetically actuated switch includes a magnet on an actuating member in repulsion between two magnet portions on arm portions of the switch. This example embodiment is schematically illustrated in FIGS. 1 and 2. When the actuating member 170 of the switch is in the open/off position, for example the position shown in FIG. 1, the magnet 172 of the actuating member 170 is in repulsion with the magnet portions 157 and 160 of the arm portions 143 and 148 of the switch. The magnet portion 157 includes a north pole 158 on one side and a south pole 159 on the other side, the magnet portion 160 includes a north pole 161 on one side and a south pole 162 on the other side, and the magnet 172 includes a north pole 173 on one side and a south pole 174 on the other side. The magnet portions 157 and 160 horizontally align and have a center line 164, and the magnet 172 has a center line 175. One side of the actuating member's magnet 172 includes the south pole 174, which is adjacent the south pole 159 of the magnet portion 157 on the arm portion 143 and creates a repulsion force 185, and the other side of the actuating member's magnet 172 includes the north pole 173, which is adjacent the north pole 161 of the magnet portion 160 on the arm portion 148 and creates a repulsion force 186. The repulsion forces 185 and 186 of the magnets 157, 160, and 172 in this position keep the contacts of the switch open.

When the actuating member 170 of the switch is in the closed/open position, for example the position shown in FIG. 2, the magnet 172 of the actuating member 170 is in repulsion with the magnet portions 157 and 160 of the arms 143 and 148 of the switch. The repulsion forces 185 and 186 of the magnets 157, 160, and 172 in this position keep the contacts of the switch closed.

The magnetically activated switch could be used with any suitable application. An example of a suitable application is a float actuated switch for use with a pump.

When used with a float actuated switch, a float could be connected to the actuating member 170. As the liquid level changes, the float moves the actuating member 170 upward so that the center lines 164 and 175 move past each other, the magnet 172 moving upward and the magnet portions 157 and 160 moving downward, and the switch transitions from one position to another. For example, the switch could move from the open/off position to the closed/on position, or vice versa.

Although a three magnets design is shown and described, it is recognized that two or more magnets could be used, at least one magnet on an actuating member and at least one magnet on an arm member. An advantage to the three magnets design is that the two magnet portions of the arm portions provide forces that keep the magnet of the actuating member between the two magnet portions of the arm portions, which assists in stabilizing movement of the actuating member so that it is not pulled to one side or the other. Because the side to side forces from these magnets counteract each other, this reduces friction on the actuating member and the switch arm portions thereby reducing wear and binding problems.

In one embodiment, an example of using a three magnets design with a standard electrical switch is illustrated in FIGS. 3-9. A magnetically activated switch 100 generally includes a switch 118 and an actuating member 170, which are at least partially contained within a housing 102.

Figure 3:
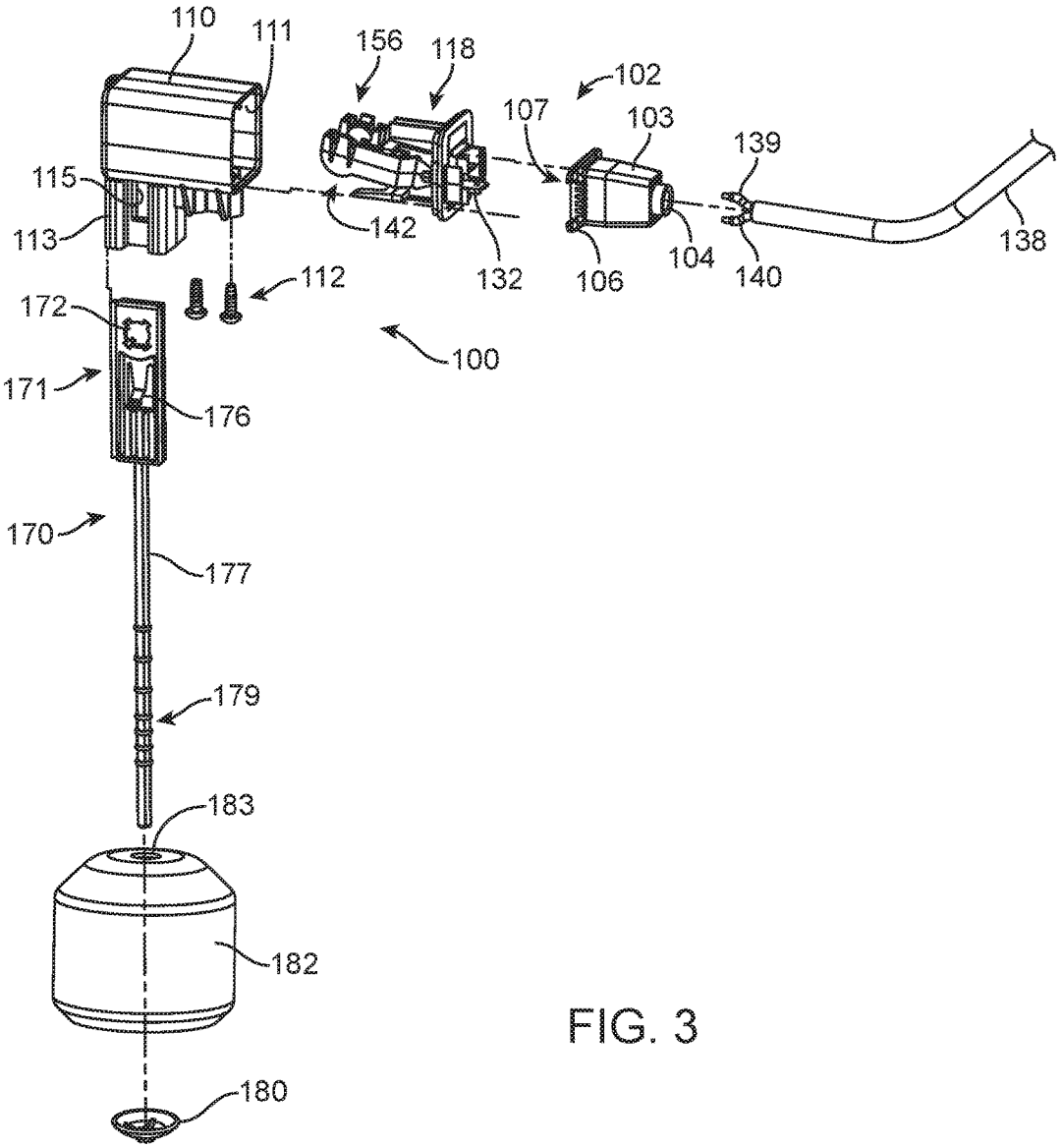
FIG. 3 is a partially exploded perspective view of a magnetically activated switch assembly constructed in accordance with the principles of the present invention.
Figure 3A:
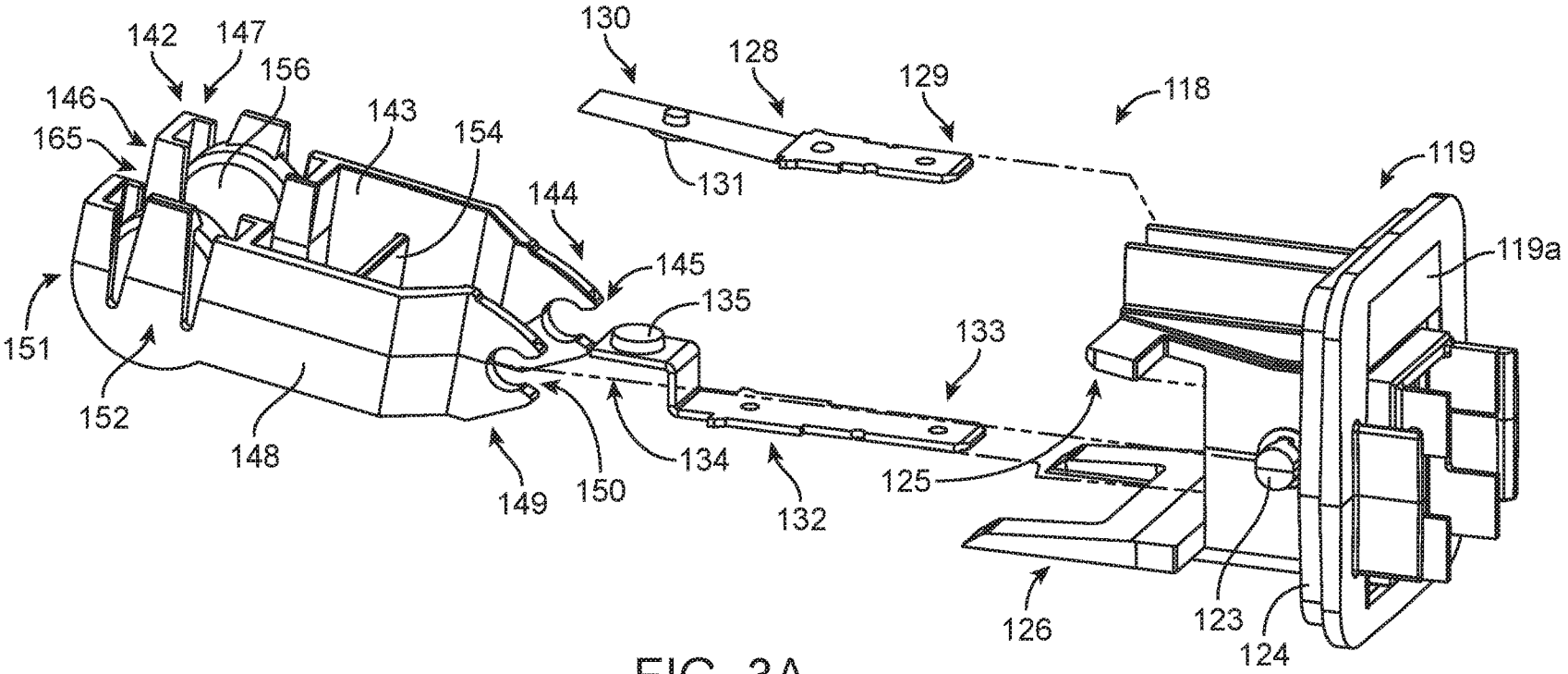
FIG. 3A is an exploded perspective view of a switch assembly of the magnetically activated switch assembly shown in FIG. 3.
Figure 3B:
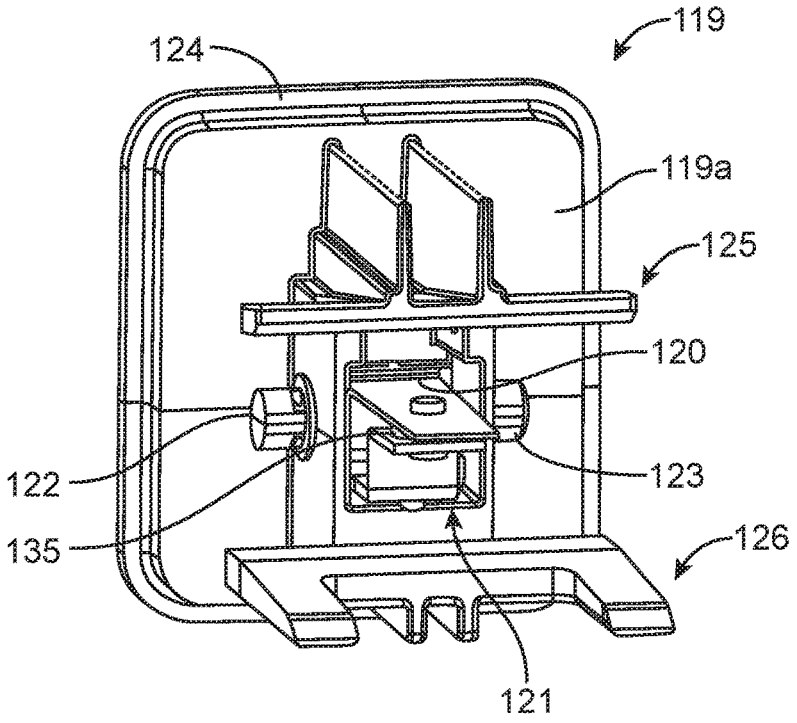
FIG. 3B is a front perspective view of first and second terminals and a base of the switch assembly shown in FIG. 3A.
Figure 3C:
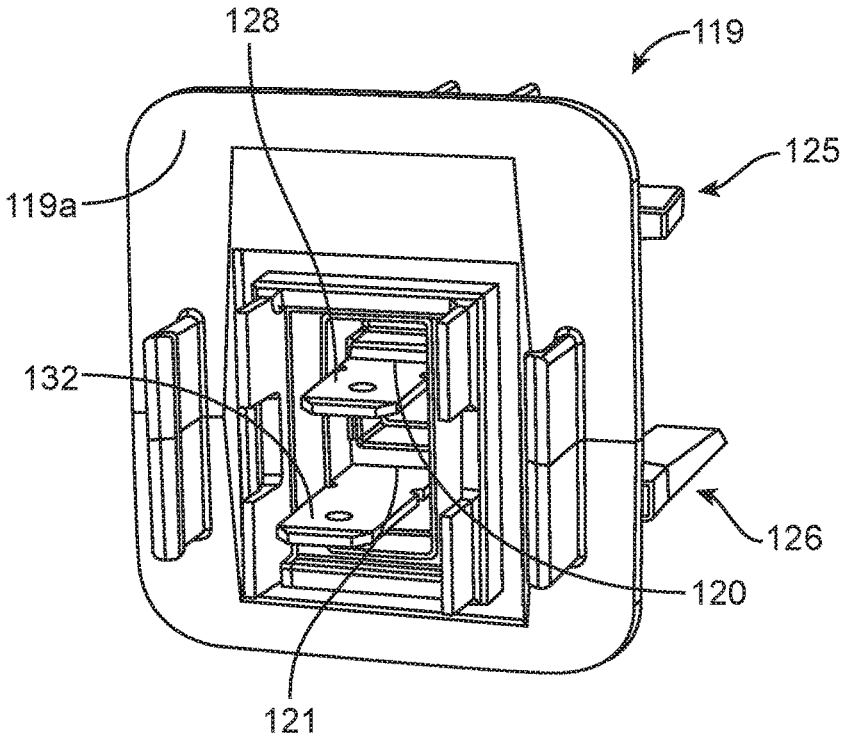
FIG. 3C is a rear perspective view of first and second terminals and a base of the switch assembly shown in FIG. 3A.

The switch 118, shown in FIGS. 3 and 3A, includes a base 119 having a generally square plate member 119*a* about which a flange 124 extends. The plate member 119*a* includes a recessed area for receiving a flange 106 of a terminal housing portion 103 proximate one side of the plate member 119*a*. The plate member 119*a* also includes a first slot 120 and a second slot 121 positioned within the boundaries of the recessed area. The first and second slots 120 and 121 receive portions of first and second terminals 128 and 132, respectively. The terminals 128 and 132 are slid through the slots 120 and 121, connected to the wires 139 and 140, and then they could be secured with epoxy within the terminal housing portion 103. A portion of the base 119 extending outward from the plate member 119*a* includes a first protrusion 122 and a second protrusion 123 extending outward laterally proximate the other side of the plate member 119*a*. A top extension 125 extends outward from the base 119 above the protrusions 122 and 123, and a bottom extension 126 extends outward from the plate member 119*a* below the protrusions 122 and 123.

A lever or arm member 142 includes a first arm portion 143 and a second arm portion 148 forming a channel 165 therebetween. The first arm portion 143 includes a first end 144 with a notch 145 that receives the first protrusion 122 and a second end 146 with a receiver 147 that receives a first portion 157 of a first magnet 156. The second arm portion 148 includes a first end 149 with a notch 150 that receives the second protrusion 123 and a second end 151 with a receiver 152 that receives a second portion 160 of the first magnet 156. As shown in FIG. 3A, the receivers 147 and 152 include arms with inward projecting protrusions, and as the magnet portions are inserted into the receivers, the arms flex or deflect outwardly until the magnet portions are seated within the receivers, and then the arms move inwardly so that the protrusions are positioned proximate the tops of the magnet portions to keep them seated within the receivers. The first magnet 156 includes the first portion 157 having a north pole 158 and a south pole 159 and the second portion 160 having a north pole 161 and a south pole 162. The first and second portions 157 and 160 are aligned and have a center line 164. The first and second arm portions 143 and 148 pivot about the respective protrusions 122 and 123. A connector 154 interconnects the first arm portion 143 and the second arm portion 148 and selectively engages the first terminal 128, as is described in more detail in the following description.

The first terminal 128 includes a first end 129, a portion of which extends through the first slot 120, and a second end 130 including a contact 131. As shown in FIG. 3A, the second end 130 is thinner than the first end 129 so that it can flex or deflect more easily. The second terminal 132 includes a first end 133, a portion of which extends through the second slot 121, and a second end 134 including a contact 135. The contacts 131 and 135 are adapted to selectively contact one another.

A power cord 138 includes a first wire 139 and a second wire 140. The first wire 139 connects to the first end 129 of the first terminal 128, and the second wire 140 connects to the first end 133 of the second terminal 132.

Figure 3D:
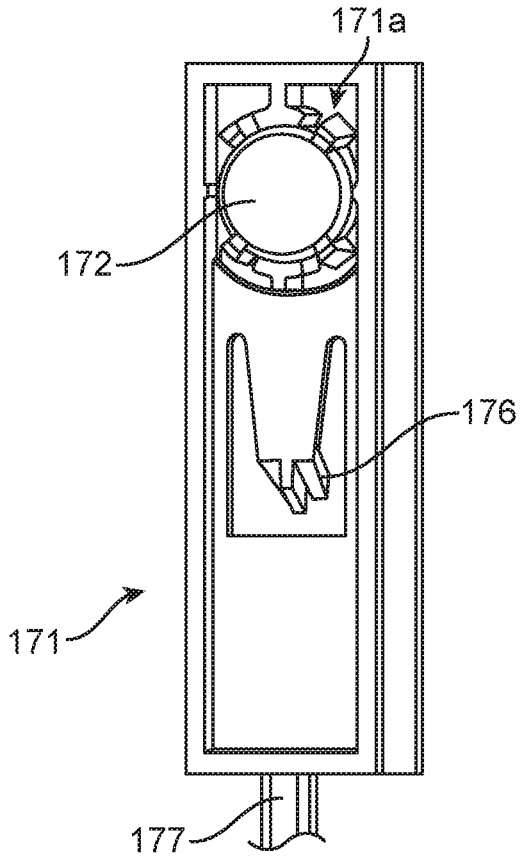
FIG. 3D is a rear view of a connecting member of the magnetically activated switch assembly's actuating member shown in FIG. 3.
Figure 4:
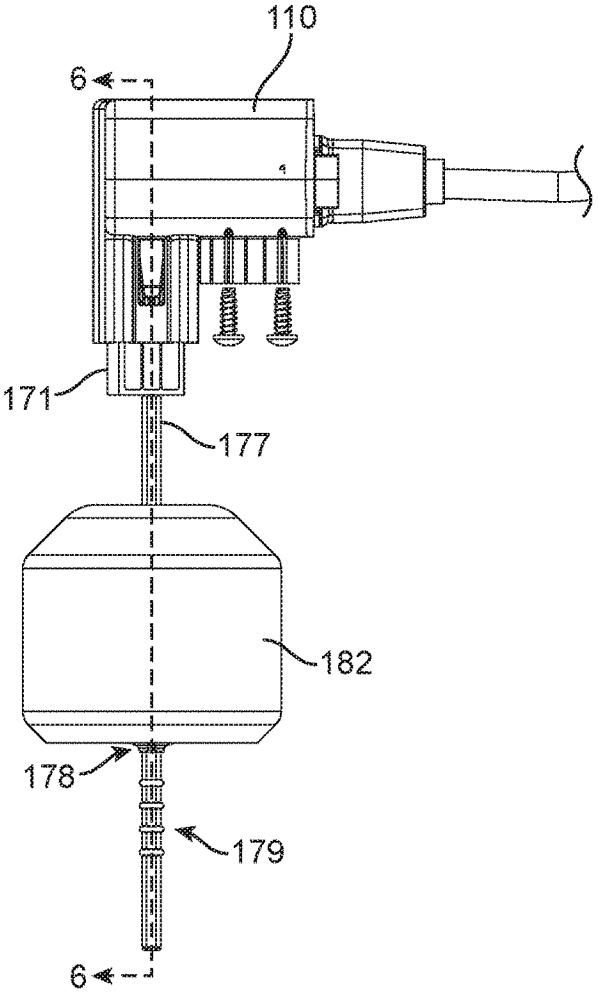
FIG. 4 is a side view of the magnetically activated switch assembly shown in FIG. 3 in an open/off position.
Figure 6:
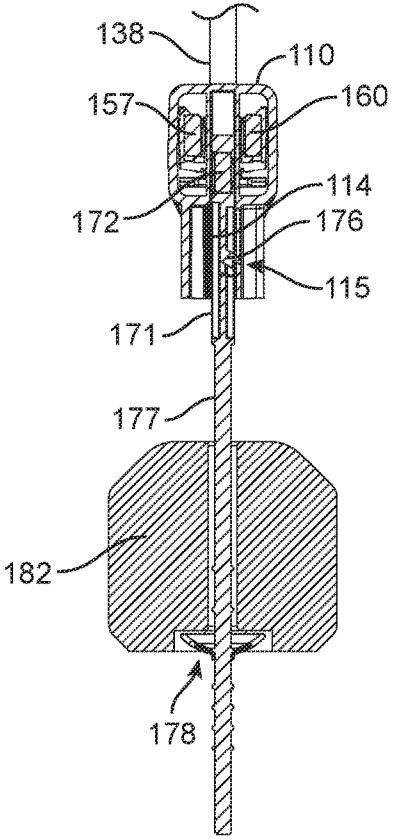
FIG. 6 is a cross section view of the magnetically activated switch assembly shown in FIG. 4 taken along the lines 6-6.

A lift rod or actuating member 170 includes a connecting member 171 to which a second magnet 172 is connected, and the connecting member 171 is positioned within the channel 165 between the first and second arm portions 143 and 148. As shown in FIG. 3D, the second magnet 172 is held in place via inwardly extending protrusions 171*a*. The second magnet has a north pole 173 and a south pole 174 and has a center line 175. A protrusion 176 extends laterally outward from a side of the connecting member 171, and a rod 177 is connected to an end of the connecting member 171. The rod 177 extends through a bore 183 of a float 182, and a stop member 178 is connected to a distal end of the rod 177. The stop member 178 is preferably adjustable along a length of the rod 177 to adjust the distance between the stop member 178 and the connecting member 171 thereby adjusting the distance the float travels along the rod 177. The stop member 178 could be a push on washer 180 or any other suitable stop member and the rod 177 could include at least two flanges 179 extending outward therefrom to keep the stop member 178 in a desired position on the rod 177.

The housing 102 includes a terminal housing portion 103, a switch housing portion 110, and a rod receiver 113. The terminal housing portion 103 forms a cavity 105 to which a bore 104 on one end and an opening 107 on the other end provide access. A flange 106 extends outwardly from the terminal housing portion 103 about the opening 107 and provides a surface to which the switch base's flange 124 is connected. The power cord 138 extends through the bore 104 and the wires 139 and 140 are connected to the terminals 128 and 132 within the cavity 105. The cavity 105 is preferably filled with epoxy or other seal substance to assist in securing the connections and providing a seal. This creates a water cut preventing water from traveling along the wires into the switch housing.

The switch housing portion 110 includes a cavity 111 for receiving the switch 118, and the switch housing portion 110 and the bottom extension 126 include aligning apertures through which the fasteners 112 extend to interconnect the switch housing portion 110 and the switch 118.

The rod receiver 113 includes a cavity 114 in fluid communication with the cavity 111 and includes a window 115 on one side. The cavity 111 and the cavity 114 receive a portion of the connecting member 171, which moves longitudinally within the cavities 111 and 114. The protrusion 176 of the connecting member 171 extends through the window 115 to provide an easy, snap-in assembly as no additional pins or securing members are needed to hold the connecting member 171 in place within the cavities 111 and 114 and provide an indication of its position within the cavities 111 and 114.

Generally, in this example embodiment, two outer magnets are in repulsion with a center magnet. In the closed/on position, the pivotable arm member is not touching the terminals thereby reducing the chance that vibration from the pump could open the contacts. The arm member can be positioned so that, for the first few degrees of movement (initial movement) of the arm member, it does not touch the terminals. The initial movement of the arm member can be optimized to ensure that optimal force is available to open the contacts/terminals. This initial movement also allows momentum to build up in the arm member that can be used to open the contacts/terminals. If the contacts/terminals of the switch become stuck, the optimization of the magnets strength and the addition of the momentum of the arm member due to its initial movement can be used to move the contacts/terminals.

Figure 5:
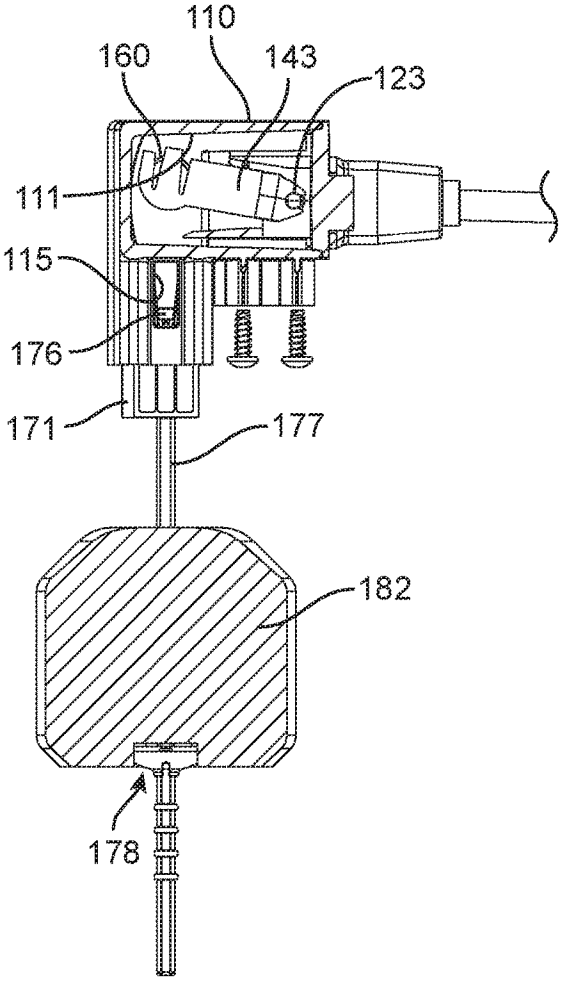
FIG. 5 is a partial cross section side view of the magnetically activated switch assembly shown in FIG. 4.
Figure 5A:
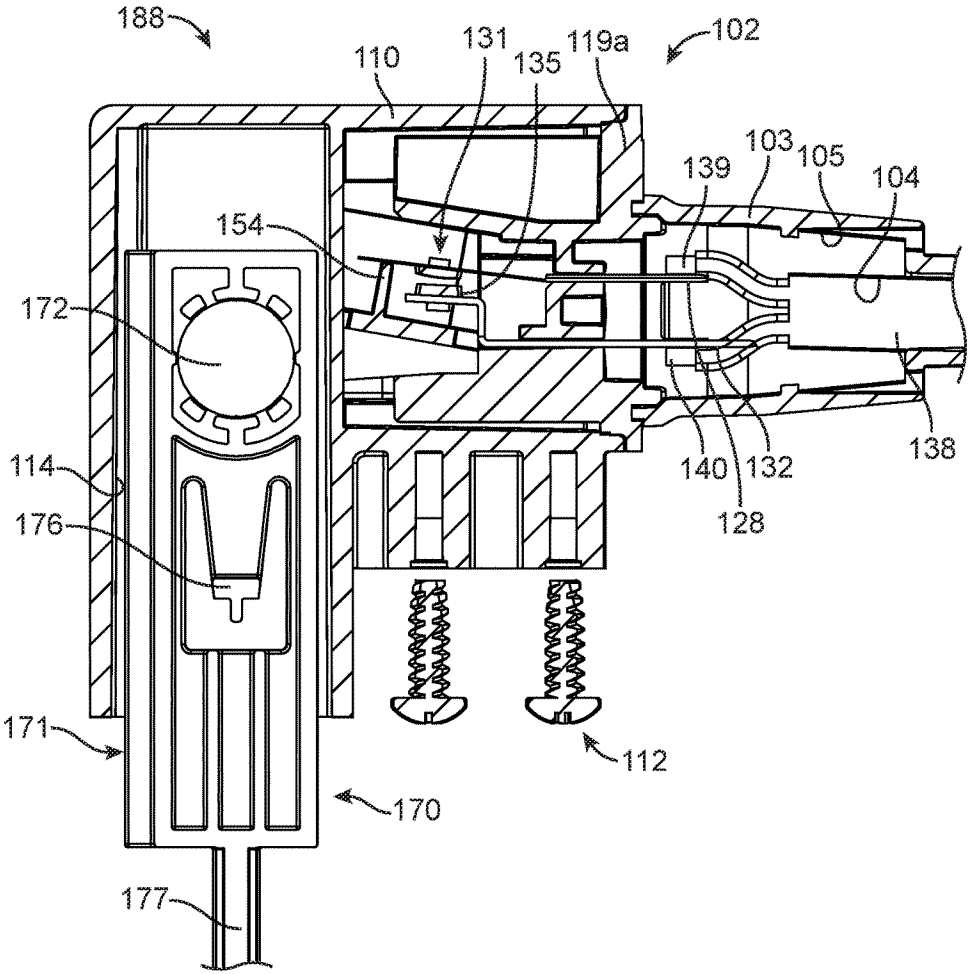
FIG. 5A is a partial cross section of a portion of the magnetically activated switch assembly shown in FIG. 3 in an open/off position.
Figure 7:
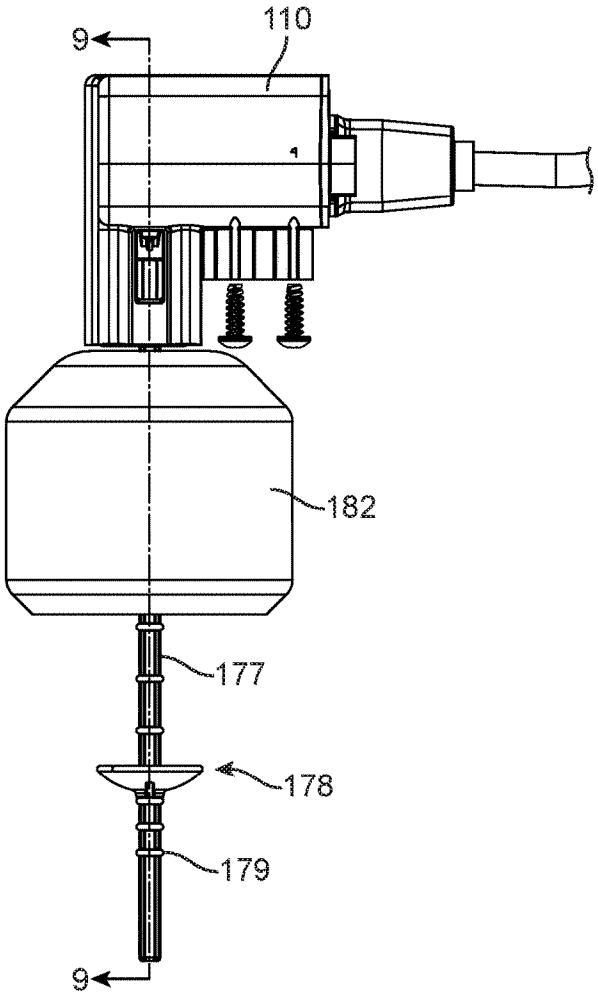
FIG. 7 is a side view of the magnetically activated switch assembly shown in FIG. 3 in a closed/on position.
Figure 9:
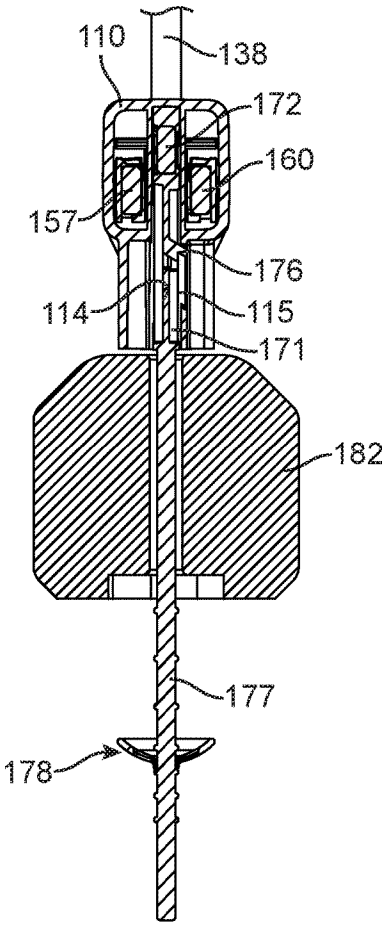
FIG. 9 is a cross section view of the magnetically activated switch assembly shown in FIG. 7 taken along the lines 9-9.

In operation, when used with a float and starting with a low liquid level, the actuating member 170 is in its down position and the repulsion forces hold the arm member 142 in an upward position, which causes the connector 154 to engage the terminal 128, flexing the second end 130 upward. Because the second end 130 of terminal 128 is thinner than the first end 129, the second end 130 easily flexes or deflects when contacted by the connector 154 thereby holding the terminal 128 away from the terminal 132 so that the respective contacts 131 and 135 are not engaged or in contact. This is shown in FIG. 5A, which depicts the switch is in the open/off position 188. As the liquid level rises, it lifts the float 182. Should the liquid level rise high enough, the float 182 contacts the connecting member 171, which moves the actuating member 170 upward.

Figure 8:
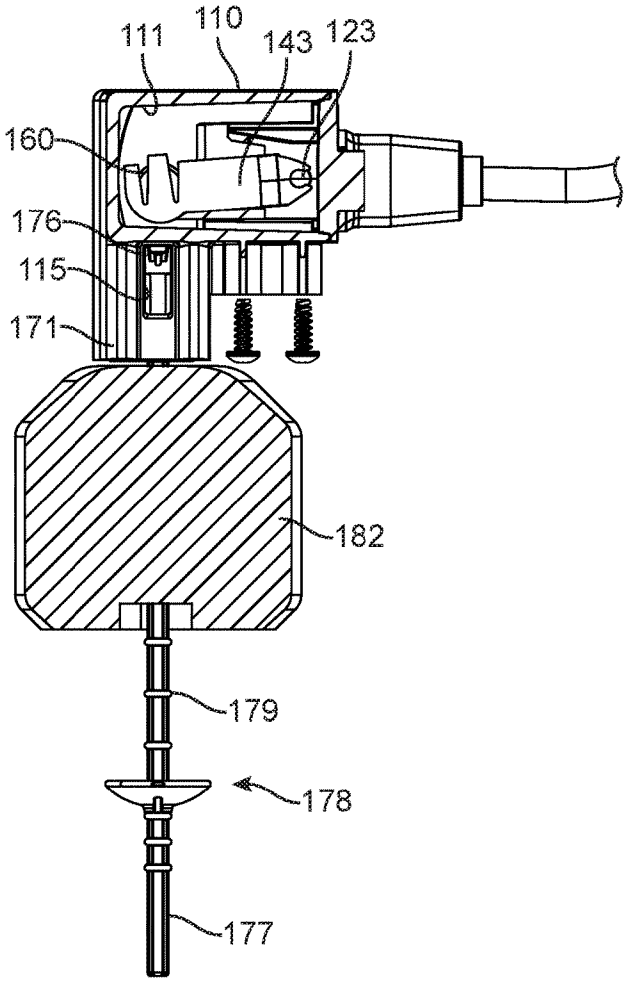
FIG. 8 is a partial cross section side view of the magnetically activated switch assembly shown in FIG. 7.
Figure 8A:
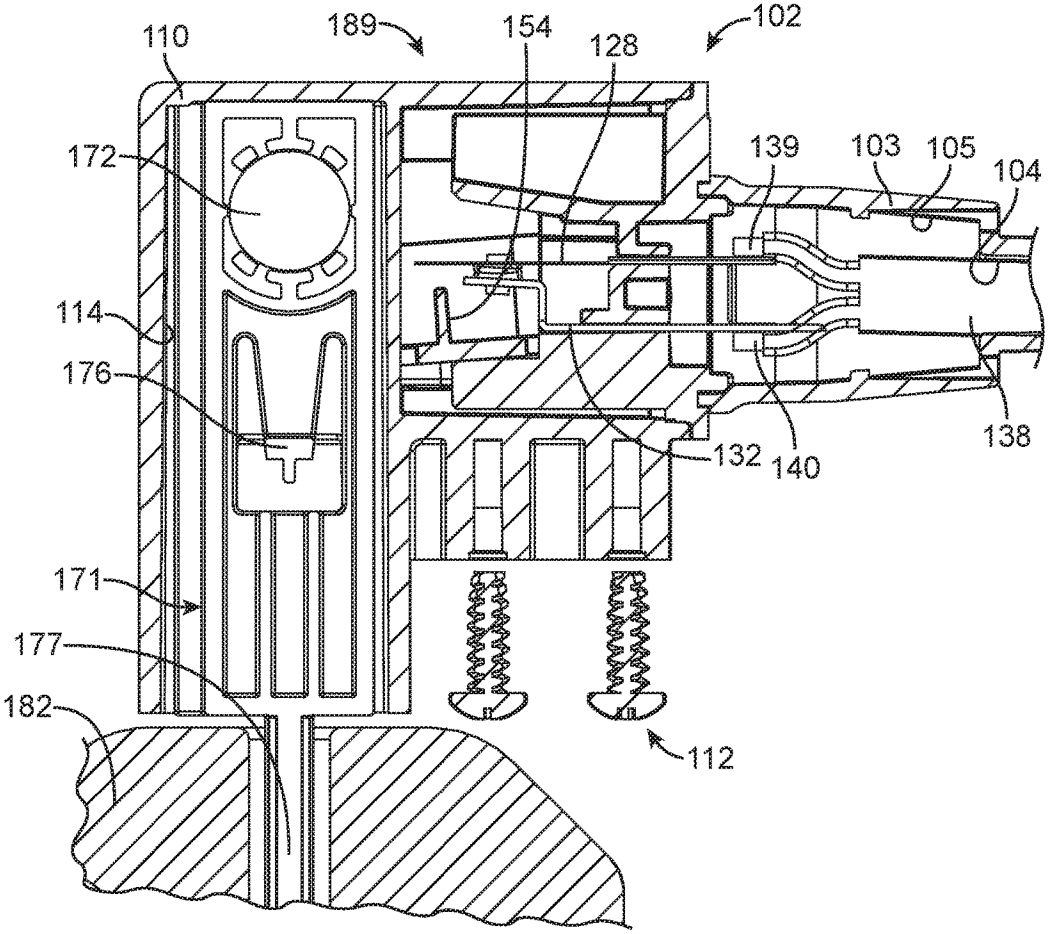
FIG. 8A is a partial cross section of a portion of the magnetically activated switch assembly shown in FIG. 3 in a closed/on position.

As the actuating member continues to move upward, the repulsion forces increase and continue to force the magnets apart keeping the switch open until the center lines (shown as 164 and 175 in FIGS. 1 and 2) of the three magnets pass each other. At this time, the net force on the actuating member and the arm portions of the switch are reversed. When this occurs, the reversal of the net force causes the arm portions of the switch to move downward and the actuating member to move upward, due to the increased repulsion forces. Due to the repulsion forces, the actuating member and the arm portions move past each other quickly in a snap-type action. This movement of the actuating member and the arm portions causes the connector 154 to move away from the terminal 128, allowing the second end 130 to move back into position so that the contact 131 contacts the contact 135, thereby closing the electrical contacts and turning on the load (e.g., a pump). As shown in FIG. 8A, the switch is in the closed/on position 189. The arm member closes the contacts, and repulsion forces from the magnets assist in holding the arm in its down position, allowing the contacts to remain closed. The bottom extension 126 acts like a stop for the connector 154 when the arm portions are in a downward position.

As the liquid level drops, the float moves downward along the rod 177 with the liquid level. When the float 182 contacts the stop member 178, the actuating member 170 is pulled downward slowly until the center lines of the magnets align. When this occurs, the actuating member 170 and the arm portions 143 and 148 are moved back to the open position and hold the terminals 128 and 132 of the switch open in the off position. In other words, as the arm member 142 pivots upward, the connector 154 engages the first terminal 128 which allows it to move upward away from the second terminal 132 so that the respective contacts 131 and 135 are disengaged or not in contact.

The terminal 128 is preferably a leaf spring that keeps the contacts 131 and 135 closed. No other types of springs are needed to keep the contacts open or closed as the repulsion forces between the magnets accomplish this. Due to the repulsion forces, the magnets push each other and their associated components apart. The actuating member is pushed up or down with the float depending upon the liquid level. When the rod is pushed up or down, the center lines of the magnets move past each other causing net forces to reverse thereby moving the switch arm to close or open the contacts of the switch.

The float travels up and down along a rod of the actuating member based on liquid level. When the float reaches the top of the rod proximate the connecting member, the rod moves upward and, when the float reaches the bottom of the rod proximate the stop member, the rod moves downward. The distance the float travels between the top and the bottom could be adjusted. A stop member, such as a push-on washer and at least two flanges extending outwardly from the rod, could be used to adjust the distance the float could travel along the rod thereby allowing the liquid level controlled by the pump to be adjusted. The washer is designed so that it can be is easily pushed up by user to reduce the available float movement but when the float makes contact with the washer it does not easily move down. In other words, the washer moves easily upward along the rod but not easily downward along the rod because of the configurations of the washer and the rod. Any suitable friction member or engaging member could be used as a stop member.

Many variations of this design could be used. For example, one design variation could include contacts that are biased with a biasing member (e.g., a spring) to assist in keeping the switch in an open position or a closed position even when the actuating member is not acting on the switch arm. Other design variations could include having the switch arm used to actuate a plunger type switch or a lever type switch of a standard electrical switch. All of these designs could still use the principle of using magnets, for example, a magnet of an actuating member in repulsion between at least one magnet of a switch arm. When the magnets move past each other, this movement opens and closes the contacts of the switch. Although three magnets are preferred, it is recognized that two or more magnets in repulsion could be used.

The use of a float and an actuating member (e.g., lift rod) is illustrated as an embodiment of the invention in the Figures, but it is recognized that the actuating member could be replaced with other suitable members including a pivoting arm, a sliding member, a rotating member, a flexing member, or a bending member.

The switch arm of the switch is illustrated as an embodiment of the invention in the Figures as a pivoting arm, but it is recognized that the switch could be replaced with other sliding, rotating, flexing, or bending members.

Further, it is recognized that the present invention is not limited to use with a float actuated switch and could be utilized in different applications.

Figure 10:
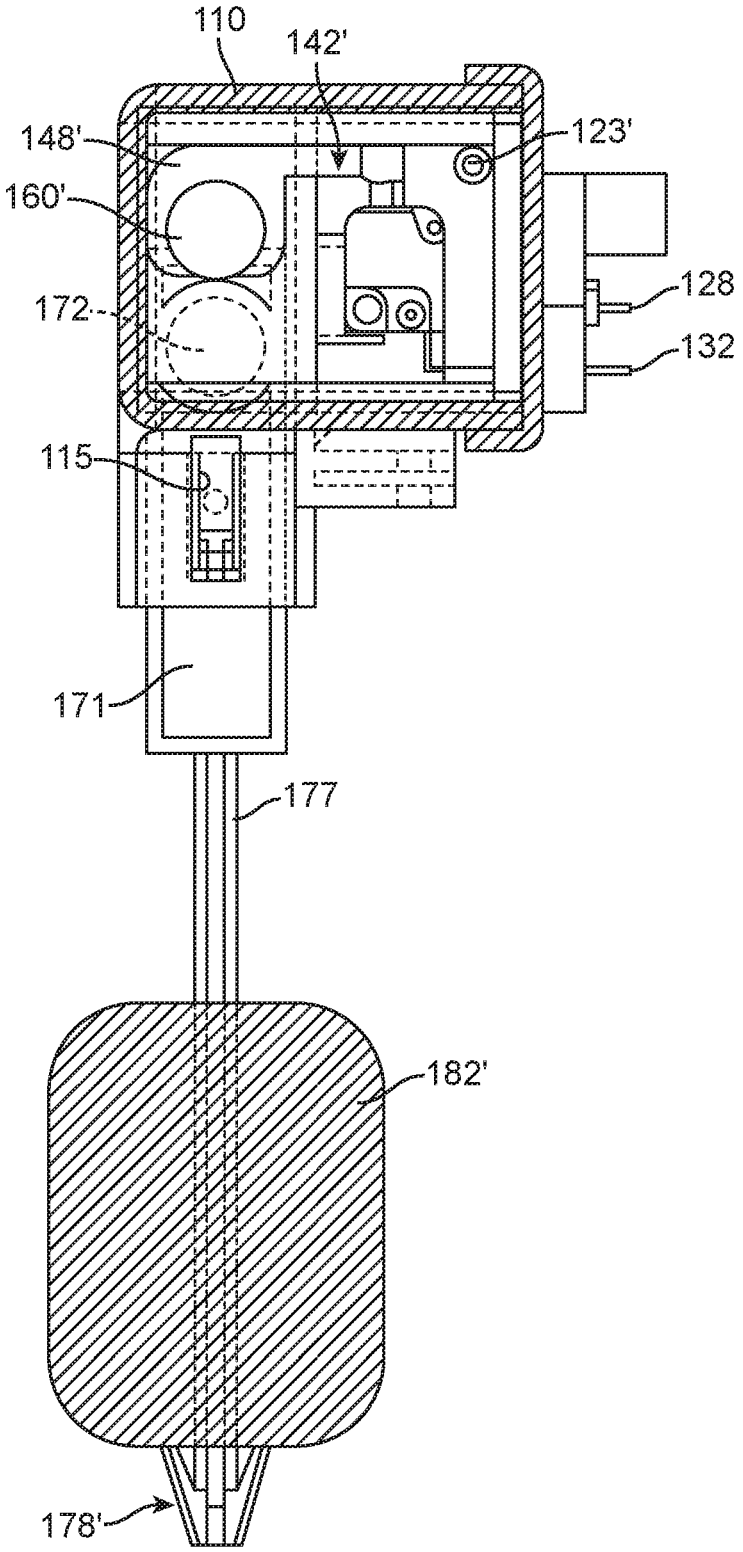
FIG. 10 is a partial cross section view of another embodiment magnetically activated switch assembly in an open/off position constructed in accordance with the principles of the present invention.
Figure 11:
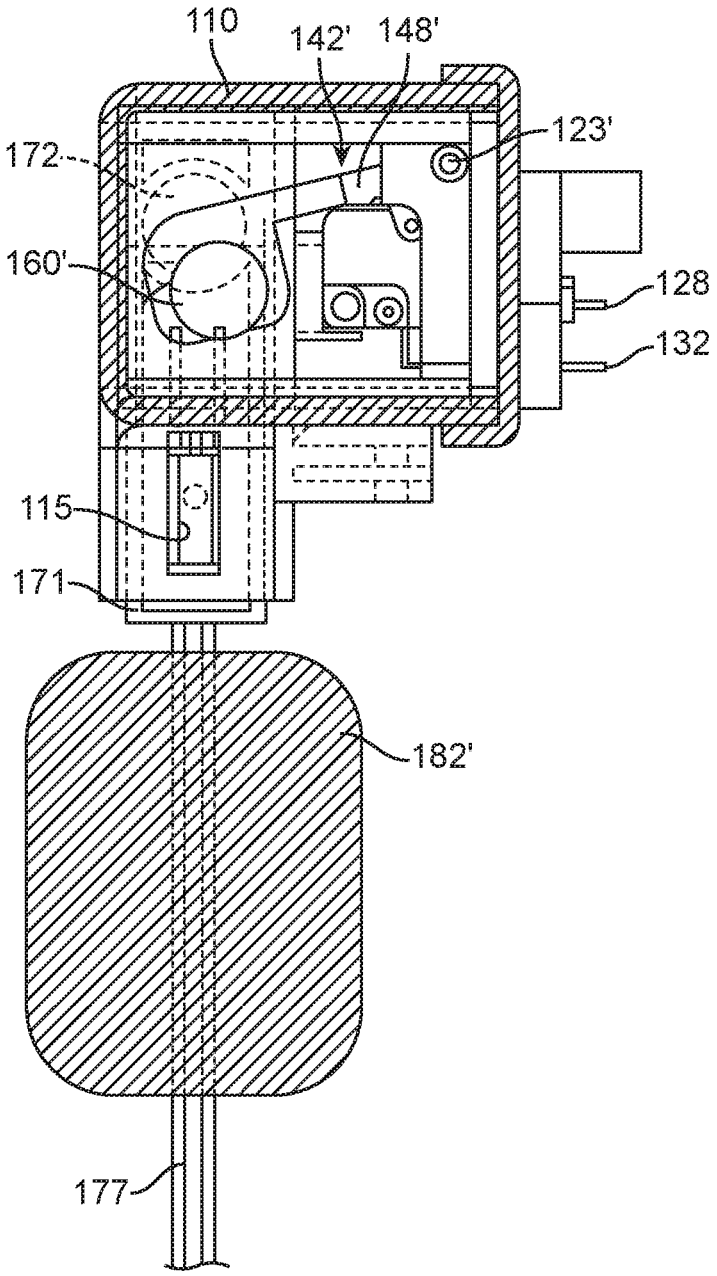
FIG. 11 is a partial cross section view of the magnetically activated switch assembly shown in FIG. 10 in a closed/open position.

FIGS. 10 and 11 illustrate another embodiment magnetically activated switch. This embodiment is similar to the magnetically activated switch 100 and, therefore, only the significant differences are being described. The same reference numerals are used for some of the common components.

Rather than being positioned generally below the terminals 128 and 132, the protrusions including a second protrusion 123' are positioned generally above the terminals 128 and 132. Therefore, the arm member 142' pivots generally downward rather than generally upward to selectively engage the terminal 128 to close and open the contacts. As shown, the second arm portion 148' to which the second magnet portion 160' is connected pivots about the second protrusion 123'. The arm member 142' could be similarly constructed to place a downward force on the terminal 128 so that its contact contacts the contact of terminal 132. Alternative types of a float 182' and a stop member 178' that could be used are shown.

Figure 12:
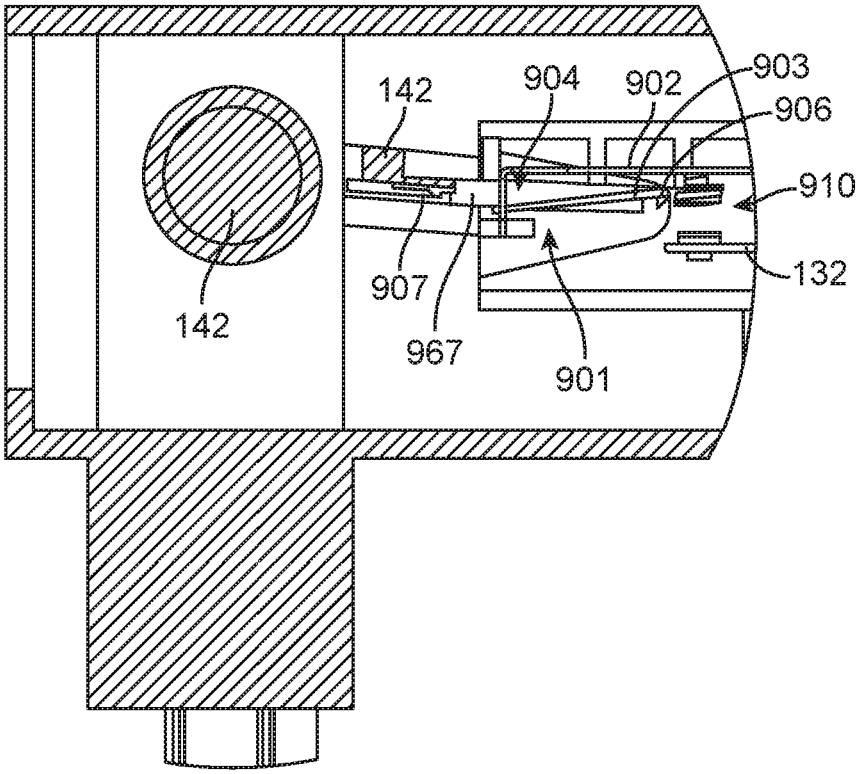
FIG. 12 is a cross section view of a portion of another embodiment magnetically activated switch assembly in an open/off position constructed in accordance with the principles of the present invention.
Figure 13:
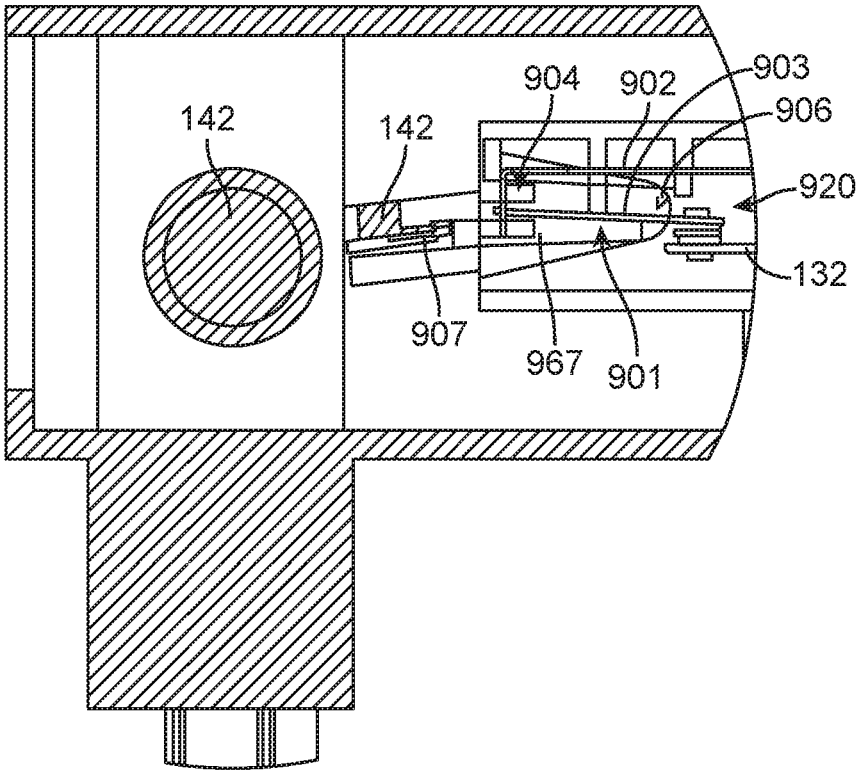
FIG. 13 is a cross section view of the portion of the magnetically activated switch assembly shown in FIG. 12 in a closed/open position.

Another embodiment is shown in FIGS. 12 and 13. As illustrated in this embodiment, one of the terminals could be made from two pieces. For example, a terminal 901 could include a stationary member 902 and a movable member 903, which pivots about a pivot point 904 where the two members are connected. Optionally, biasing member 967 could interconnect the terminal 901 and the arm member 142 to place a biasing force on the arm member 142. The biasing member 967 could be connected to the terminal 901 at a connection 906 proximate a distal end of the movable member 903 and could be connected to the arm member 142 at location 907 by any suitable connecting means, such as an aperture in one component through which a wire or a pin connected to the other component extends. The biasing force could supplement the repulsion forces of the magnets in keeping the arm member 142 and the terminal 901 in the open/off position 910, shown in FIG. 12. For example, when the arm member 142 is in an upward position relative to the magnet of the actuating member (not shown in FIGS. 12 and 13), the biasing force of the biasing member 967 assists in positioning the movable member 903 in an upward position. The biasing force works similarly with the switch in the closed/on position 920, shown in FIG. 13. The force would supplement repulsion of the magnets in keeping the arm member 142 and the terminal 901 in the closed/on position 920. For example, when the arm member 142 is in a downward position relative to the magnet of the actuating member (not shown in FIGS. 12 and 13), the biasing force of the biasing member 967 assists in positioning the moveable member 903 in a downward position.

Although the present invention has been described for operation of a pump or other liquid level control device, but it is recognized that the present invention could be utilized for any mechanism activated with movement of an actuating member.

The above specification, examples, and data provide a complete description of the manufacture and use of the composition of embodiments of the invention. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the invention. Therefore, it is manifestly intended that this invention be limited only by the claims and the equivalents thereof.

The invention claimed is:

1. A magnetically activated switch, comprising:

an arm member having a first magnet, the first magnet including a first magnet portion and a second magnet portion spaced apart to form a channel therebetween;

an actuating member having a second magnet, the actuating member being configured and arranged to move relative to the arm member thereby moving the second magnet relative to the first magnet, the second magnet moving through the channel, the second magnet having a repulsion force to the first magnet, the second magnet having a north pole on a first side and a south pole on a second side, the first magnet portion having a north pole on a side adjacent the first side of the second magnet and the second magnet portion having a south pole on a side adjacent the second side of the second magnet when the second magnet is moving through the channel; and a switch having a contact, wherein movement of the second magnet in a first direction past the first magnet positions the contact in an open position and movement of the second magnet in a second direction past the first magnet positions the contact in a closed position.

2. The magnetically activated switch of claim 1, wherein the arm member includes a first arm portion to which the first magnet portion is connected and a second arm portion to which the second magnet portion is connected, the first and second arm portions being spaced apart to form the channel through which the actuating member moves.

3. The magnetically activated switch of claim 1, wherein the first and second magnets cause the arm member and the actuating member to move in opposite directions relative to one another, movement of the arm member and the actuating member in first opposite directions position the contact in the open position, and movement of the arm member and the actuating member in second opposite directions position the contact in the closed position.

4. The magnetically activated switch of claim 1, further comprising a float operatively connected to the actuating member, wherein change in a liquid level in which the float is positioned causes the float to move the actuating member relative to the arm member.

5. The magnetically activated switch of claim 4, wherein the actuating member includes a rod along which the float moves.

6. The magnetically activated switch of claim 5, wherein the rod includes a stop member movable along a length of the rod to vary a distance the float moves along the rod.

7. The magnetically activated switch of claim 1, wherein the arm member is a lever of an electrical switch.

8. The magnetically activated switch of claim 1, further comprising a spring placing a biasing force on the switch to assist in positioning the contact in the open and closed positions.

9. The magnetically activated switch of claim 1, wherein the actuating member is selected from the group consisting of a pivoting arm, a sliding member, a rotating member, a flexing member, or a bending member.

10. A magnetically activated switch, comprising:

an arm member having a first arm portion to which a first magnet portion is connected and a second arm portion to which a second magnet portion is connected, the first arm portion and the second arm portion forming a channel therebetween;

an actuating member having a second magnet, the actuating member being configured and arranged to move relative to the arm member through the channel thereby moving the second magnet relative to the first magnet portion and the second magnet portion, the second magnet having repulsion forces to the first magnet portion and the second magnet portion, the second magnet having a north pole on a first side and a south pole on a second side, the first magnet portion having a north pole on a side adjacent the first side of the second magnet and the second magnet portion having a south pole on a side adjacent the second side of the second magnet when the second magnet is moving through the channel; and a switch having a contact, wherein movement of the second magnet in a first direction past the first magnet portion and the second magnet portion positions the contact in an open position and movement of the second magnet in a second direction past the first magnet portion and the second magnet portion positions the contact in a closed position.

11. The magnetically activated switch of claim 10, further comprising a float operatively connected to the actuating member, wherein change in a liquid level in which the float is positioned causes the float to move the actuating member relative to the arm member.

12. The magnetically activated switch of claim 11, wherein the actuating member includes a rod along which the float moves.

13. The magnetically activated switch of claim 12, wherein the rod includes a stop member movable along a length of the rod to vary a distance the float moves along the rod.

14. The magnetically activated switch of claim 10, wherein the arm member is a lever of an electrical switch.

15. The magnetically activated switch of claim 10, further comprising a spring placing a biasing force on the switch to assist in positioning the contact in the open and closed positions.

16. The magnetically activated switch of claim 10, wherein the actuating member is selected from the group consisting of a pivoting arm, a sliding member, a rotating member, a flexing member, or a bending member.

* * * * *